United States Patent [19]

Blakeslee

[11] 4,272,567

[45] Jun. 9, 1981

[54] CONTROLLED DISPERSION OF COATING INSIDE NON-CIRCULAR HOLLOW ARTICLES

[75] Inventor: Harry N. Blakeslee, Barrington, Ill.

[73] Assignee: American Can Company, Greenwich, Conn.

[21] Appl. No.: 113,366

[22] Filed: Jan. 18, 1980

Related U.S. Application Data

[62] Division of Ser. No. 961,513, Nov. 17, 1978, Pat. No. 4,233,932.

[51] Int. Cl.[3] ..... B05D 1/02

[52] U.S. Cl. ..... 427/236; 118/306; 118/317; 118/DIG. 10; 427/240; 427/421

[58] Field of Search ..... 239/222.11, 223, 224; 427/236, 240, 421; 118/306, 317, DIG. 10

[56] References Cited

U.S. PATENT DOCUMENTS

| | | | |
|---|---|---|---|
| 228,773 | 6/1880 | Morahan | 427/236 |
| 1,560,527 | 11/1923 | Bassler | 239/222.11 |
| 2,087,627 | 7/1937 | Nyrop | 239/224 |
| 2,294,221 | 8/1942 | Bowen et al. | 239/222.11 X |
| 2,986,338 | 5/1961 | Foster | 239/224 X |
| 3,044,441 | 7/1962 | Blakeslee et al. | 239/223 X |
| 3,452,931 | 7/1969 | Knowles | 239/224 X |
| 3,455,728 | 7/1969 | Kiwiet | 427/236 |
| 3,472,201 | 10/1969 | Quackenbush | 118/317 |

FOREIGN PATENT DOCUMENTS

| | | | |
|---|---|---|---|
| 1032987 | 6/1978 | Canada | 239/223 |
| 2526702 | 12/1976 | Fed. Rep. of Germany | 427/236 |
| 873914 | 8/1961 | United Kingdom | 427/236 |

*Primary Examiner*—Shrive P. Beck

*Attorney, Agent, or Firm*—Robert P. Auber; George P. Ziehmer; Aaron Passman

[57] ABSTRACT

A coating spraying system is shown for use in spraying the internal surfaces of a hollow container. The system includes a spinning element for dispersion of the coating and a specifically configured metering orifice for pre-shaping the mass of the coating radially disbursed by the spinning head.

3 Claims, 6 Drawing Figures

FIG. 1
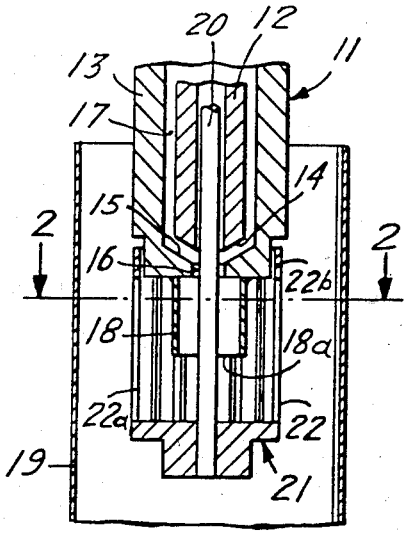
FIG. 4
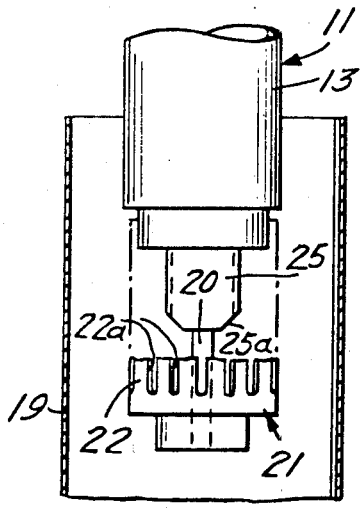
FIG. 2
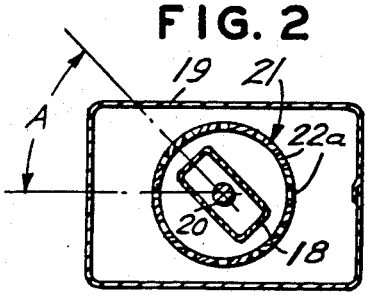
FIG. 5
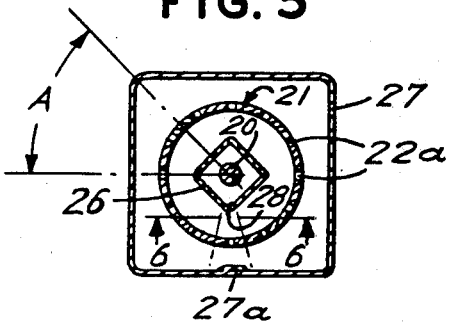
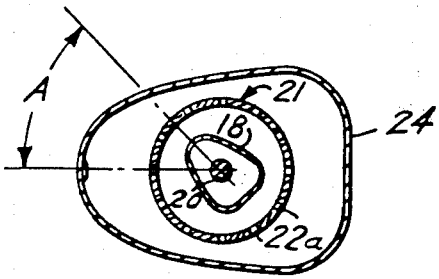
FIG. 3
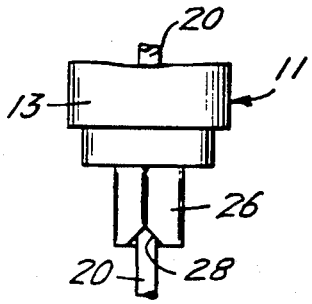
FIG. 6

CONTROLLED DISPERSION OF COATING INSIDE NON-CIRCULAR HOLLOW ARTICLES

This is a division of application Ser. No. 961,513, filed Nov. 17, 1978 now U.S. Pat. No. 4,233,932.

BACKGROUND OF THE INVENTION

The present invention pertains to an apparatus for spray coating the interior surface of hollow articles and, in particular, to a spinning sprayer nozzle having a novel configuration for precisely distributing the coating material.

A typical apparatus commonly used for coating interior surfaces of hollow articles is a spin sprayer as shown in U.S. Pat. No. 3,044,441. A disadvantage of that type of spin sprayer is the difficulty encountered in producing even coatings on the interior surfaces of hollow articles which are non-circular in cross-section. That is to say that, containers with irregular cross-section such as cans for ham and other meat products which have specifically shaped cross-sections to accommodate the meat configuration are difficult to coat evenly around their inside periphery with a rotary spinning type sprayer. Candy, cocoa and institutional cans having a general square cross-sections present similar coating problems. The method of coating the interior surfaces of such containers requires a lancing movement of the sprayer such that the central axis of the spinning element is moved in and out of the container to evenly coat only the internal area as required. Such axial movements keep the distribution of coating equal from top to bottom (along the axis) of the container, and by timing the flow to continue while the sprayer is in the container, the injection of a deposit of coating material into the spinning sprayer the coating is disbursed during lancing as necessary.

To distribute the coating evenly on the interior surfaces of non-circular containers, it has been known to move the axis of the sprayer such that the inside walls are presented for coating at an equal distance around the container inside periphery. Similarly, the container can also be moving in a non-circular path perpendicular to its axis whereby the coating can be equally distributed about the interior surfaces. Either of the aforementioned techniques presents problems with regard to the mechanism designed for high-speed production of a container with an accurately and an evenly distributed coating. The previous techniques are complicated, expensive and disadvantageous for use. It is desirable that a system be used which can be readily and easily adaptable to various shape containers. Such a system would have conveying or container handling equipment similar to that required for spin spraying round (circular) containers thereby eliminating the need for the complicated movements previously set forth. To provide the equal coating distribution, a modified nozzle is disclosed for coating the inner surfaces of a container.

Another problem not easily solved by the prior art spin spraying systems, which can be handled by a modified nozzle, is the selected uneven distribution of coating. More particularly, it is sometimes desirable to apply a heavier coating to a particular inside area; for example, along the side seam of the container whereby the seam edge is given a double thickness coating. The concept disclosed herein with a relatively slight modification is easily adapted to apply a greater amount of coating in a particular preselected area.

It is an object of the invention to overcome the problems of coating containers having various cross-sectional configurations by providing an easily changed spin spray nozzle adapted to disburse a coating in accordance with the cross-section of the containers.

It is another object of the invention to provide an apparatus wherein the nozzle configuration is similar to the cross-sectional configuration of the container the nozzle is designed to coat.

It is still another object of the invention to provide a nozzle design for selected uneven distribution of coating material within a given plane such that the lancing movement of the sprayer will form a preselected distribution of coating as desired on the inside surface of a hollow container.

It is a further object of this invention to provide a low cost efficient and reliable spin sprayer which is versatile in coating containers either evenly or unevenly in accordance with the particular coating problem and requirements.

The numerous other objects and advantages of the invention will be better understood from the following description taken in connection with the drawings which disclose various embodiments each designed for a different application of the basic invention.

SUMMARY OF THE INVENTION

In accordance with the foregoing objects, a spin sprayer nozzle design is disclosed which has its cross-sectional configuration substantially similar to the cross-sectional configuration of the container or tube to be coated. More particularly, a spin sprayer having an elongated drive shaft rotated by a power source and drivingly connected to a cup shaped spraying head is surrounded by a distribution system for the coating material. The distribution system includes a delivery tube connecting at one end to a pressurized coating supply having valving means for the timed dispensing of the coating materials and at the other end of the delivery tube is a shaped passage which defines the distribution of the coating as it is fed to the inside of the cupped spraying head. The mouth of the shaped passage is a configured orifice designed to limiting the dispensing of the coating to the spray head in accordance with the desired distribution for the particular application. That is to say that, at any given instance the configured orifice could supply a greater amount of coating material in a plane toward the portion of the hollow container which has a larger interior circumferential area. Similarly, the configured orifice provides less coating material to the spray head for distribution toward the portion of the interior surface which is smaller in area. More particularly, the delivery system is a fixed tube through which the drive shaft for the spray head runs such that the spray head rotates concentrically relative to the tube cross-section of the delivery system. Only in the immediate area of the mouth end of the delivery system is there a special configuration. In effect the mass of coating material is shaped by the configured orifice and is delivered to the inside of the spray head (which is rotating at high-speed) such that the centrifugal force generated radially disperses the coating in accordance with the relative quantity or amount of the delivered coating. Thus, the internal surface of the hollow container will receive a preset amount of coating in accordance with the shaped configuration of the mouth of the delivery system tube.

BRIEF DESCRIPTION OF THE DRAWINGS

FIG. 1 is a side elevational view in cross-section showing the preferred embodiment of a spinning spray nozzle showing the relative positions of the components thereof to a container to be spray coated, FIG. 2 is a sectional view taken along line 2—2 of FIG. 1 and in particular the configuration of the nozzle relative to the container configuration, FIG. 3 is a sectional view similar to that of FIG. 2 with a differently configured nozzle and container, FIG. 4 is a side elevational view partially in cross-section showing an alternate embodiment of a modified nozzle arrangement for equal distribution of coating even at the container extremities, FIG. 5 is a sectional view showing the cross-sectional configuration of an alternate embodiment of a nozzle wherein a notch is added to the nozzle orifice to increase the sprayed pattern toward, for example, the container side seam; and, FIG. 6 is a fragmenting side elevational view as taken along line 6—6 of FIG. 5 for a better illustration of the notch.

DETAILED DESCRIPTION OF THE DRAWINGS

As a preferred embodiment of the present invention FIG. 1 shows a spin sprayer assembly generally designated 11. While alternate embodiments are shown in the other figures, the common components will be labelled identically. Assembly 11 has a main inner supporting member 12 which is tubular in configuration and is carried from above for vertical movement on the assembly mounting (not shown) from which it extends vertically downward to carry the sprayer. The spray will also operate in a horizontal plane. The inner member 12 is circular in cross-section and is disposed within a larger tubular outer member 13 which is also circular in cross-section and is of a larger diameter whereby an annular passage 17 is formed between members 12 and 13. The outer member 13 is supported for longitudinal movement in the vertical direction relative to the main inner member 12. The lower portion of inner member 12 has a conically formed tip 14 which is designed to seat against a valve seat surface 15 being a mating conically formed surface disposed at the lower end of member 13. At the center of the seat surface 15 is an outlet port 16 connecting the annular passage 17 (between members 12 and 13) with a nozzle member 18.

The member 13 moves longitudinally to open and close the valve seat 15 against the conical tip 14 of the inner member 12. In accordance with the prior art spin sprayers, pressurized fluid carried through passage 17 is released through the outlet port 16 in a timed relation established by external controls for the movement of member 15 relative to member 12. The coating spray can, for example, be supplied by a reservoir (not shown) of coating liquid connected to annular passage 17. Air pressure above the sealed surface of the coating reservoir can be used to pump the coating material through passage 17 at a pressure of between two and four pounds per square inch. The valving for timing the dispersion of coating through outlet port 16 could also be located at the coating supply reservoir and be in the form of an electronically controlled solenoid valve or the like.

Referring to the nozzle member 18 of FIGS. 1 and 2, a rectangular (in cross-section) nozzle member 18 is shown. The cross-section of the nozzle member 18, FIG. 2 is similar to the cross-section of the container 19. The relation between the nozzle member configuration and the container are fundamental to the operation of the invention. The nozzle member 18 is associated with the outer member 13 such that it moves with the member 13 as the latter is longitudinally positioned relative to the fixed inner member 12. Consequently, when the valve seat 15 and the conical tip 14 are apart from one another coating material will flow through the outlet port 16 into the nozzle member 18 filling same. The natural surface tension and tenacity of the coating material relative to the walls of the nozzle member 18 cause the former to fill the latter. A slug or cross-sectional shape is imparted to the coating material by the nozzle member as the pressurized coating material passes through it.

Inner member 12 is hollow and carries a drive shaft 20 which is an elongated rod that extends up through inner member 12 at the top and to a driving device (a driving pulley, an air motor, or an electric motor, etc.) for rotating drive shaft 20 at speeds greater than 15,000 revolutions per minute. At the lower end of drive shaft 20 is carried a shaped cage basket 21 having windowed side wall 22 which form a generally upwardly extending cylindrical cage. Each window **22*a* is longitudinally disposed in the cylindrical side wall 22 forming a narrow slit extending from the bottom of the cage 21 to a top rim 22*b*; the latter surrounds the lower outer circumferential extremity of the outer member 13 whereby the nozzle member 18 is axially centered and disposed longitudinally within the middle of the cage 21 when the member 13** is at its lowest most position and the valve is open.

In operation the coating, as explained, is formed into a discrete cross-sectional shape or slug within the nozzle member 18 and is forced therethrough by the material pumped down annular passage 17 and through outlet port 16. Each formed slug is delivered to the center of the cage 21 and the viscosity of the slug maintains the general cross-section configuration defined by the nozzle member 18 outlet orifice **18*a*. The centrifugal force generated by the cage 21, rotating at high speed distributes the shaped slug radially outward toward the windowed side walls 22 in a manner common to spin sprayers for tangentially spraying portions of each shaped slug toward the inside walls of the container. Each window 22*a*** acts to impart a tangential velocity for moving the coating as it passes therethrough whereby the distribution of the coating is facilitated. More particularly, where the coating distribution of the shaped coating is greater relative to the axis about which the cage rotates, the distribution of the coating will cover a greater interior area and where the distribution of the material is less the distribution of the coating will cover a smaller interior area.

While the nozzle orifice is shaped to disburse coating so that it can be equally distributed upon a container having a similar cross-section, the alignment of the nozzle orifice with respect to the container must be angularly displaced. The angular displacement labelled A in FIGS. 2, 3 and 5 accounts for the effect of the direction of disbursion which is caused by the cage 20, and, more particularly, the windows **22*a***. By displacing angularly the nozzle orifice, its alignment relative to the alignment of the container the controlled shaped coating slug will be equally distributed to the inside of the container notwithstanding the fact that the windows 22*a* tend to thrust the coating material more tangentially than radially. The general configuration of the outlet orifice 18*a*, FIG. 2 is similar to the cross-sectional configuration of the container 19. Only the corners 18*b* have been somewhat rounded to account for less slug material at the center resulting from the drive shaft 20 which passes through the nozzle member 18. It has been found that corners 18*b* with a larger radius correct for the displaced cross-sectional area of the drive shaft 20.

In operation, the fixed outer member 13 is arranged to carry the whole assembly 11 in lancing fashion into and out of the container 19. More particularly, the sprayer assembly 11 equally distributes coating materially substantially in the plane of the windows 22*a* such that lancing movement is necessary to completely coat the inside of a container. The timing of the valve action is adjusted to supply the coating during the exact portion of the lancing movement in which the spinning sprayer is within the container.

FIG. 3 shows an alternate form of a nozzle member configuration labelled 23. The use of a special nozzle configuration for a container having a different cross-section such as a ham can 24. As depicted in FIG. 3 the modifications to the outlet orifice of the nozzle member 23 accommodate the configuration of ham can container. Various other configurations be they irregular, squared, D-shaped, oval, etc., will also be easily coated by using a correspondingly similar shape for the orifice configuration of their respective nozzles. The principle of shaping the slug works notwithstanding the container cross-section.

From the foregoing, it is apparent that variations in orifice configuration for the nozzle have a substantial influence on the distribution of the coating material. In FIG. 4, an alternate approach to nozzle orifice modification is disclosed. Again, there is the rectangular in cross-section container 19, but nozzle member 25 in FIG. 4 is square in cross-section and includes chamfered reliefs 25*a* adapted to permit more coating to be dispersed toward the far walls of the container 19. In FIG. 4, the technique of the device is such that a greater portion of the slug of coating is permitted to flow through the nozzle 25 where necessary for coating the inside of container 19. The result of the device of FIG. 4 is similar to that of FIG. 1, only the outlet orifice configuration of the nozzle has been altered, everything else operates the same for distributing an equal amount of coating to non-round containers.

FIGS. 5 and 6 show yet another technique for modifying the nozzle orifice for a specific distribution of the coating material. A nozzle 26 is shown which is generally square in cross-section. Such a nozzle 26 is adapted for coating a container 27, also square in cross-section. Again windowed cage 21, is provided to distribute the coating material and a drive shaft 20 is included for spinning the cage at high-speed. Nozzle 26 includes a notch 28 located in the lower extremity or mouth of the nozzle 26 for permitting a greater flow of coating material in a particular direction. Notch 28, in this instance is aligned with the container side seam 27*a* whereby an extra amount of coating material is sprayed toward the inside side seam 27*a* during the lancing movement of assembly 11 into and out of the container 27.

The displacement of the center of rotation for the axis of shaft 20 relative to the center of the nozzle 18, 23, 25 or 26 must be such that the positioning of the spin sprayer relative to the container 19, 24 or 27 places the axis at proportional the same location relative to the container if equal distribution of coating is desired. Conversely an offset is the sprayer axis toward one side of the container will unbalance the coating distribution.

From the foregoing those skilled in the art of spinning sprayers will appreciate that a wide variety of outlet orifice configurations could be used to produce varied coatings thickness having equal or non-equal distributions, notwithstanding the unusual cross-sectional configurations or particular requirements of the container to be spin spray coated.

The invention and its many advantages will be understood from the preceeding description, and changes in form, construction, selection and arrangement of materials and components or changes in the steps of the method and process described can be made without departing from the broader aspects of the system as set forth in the claims that follow.

What is claimed is:

1. A method of coating the inside surface of a hollow tube of a non-circular cross-section configuration comprising the steps of:

(1) inserting a coating distributing apparatus into the interior of said tube, said distributing apparatus comprising:

(a) a first means mounted for rotation about an axis at relatively high angular velocity for disbursing coating material in a radial direction from said first means, (b) a coating delivery means having a pressurized coating material supply and a transportation system connected and arranged to deliver a quantity of coating material to said first means, and (c) a shaped passage ending in a generally noncircular orifice nozzle means at the distal portion of said transportation system and generally in alignment with said axis for defining the form of said deposit for its distribution by said first means, said nozzle means having a configuration bearing a relationship to the distribution pattern desired;

(2) angularly displacing the distributing apparatus with respect to the configuration of said tube so that the coating is applied and distributed in a predetermined manner;

(3) rotating said first means and delivering pressurized coating material to said first means in order to distribute coating material in a radial pattern towards said inside surface; and, (4) adjusting the flow of the coating material through said distributing apparatus by controlling the period and amount of flow.

2. The method of claim 1 wherein said predetermined amounts form a uniformly distributed thickness of coating throughout said hollow tube.

3. The method of claim 1 wherein said predetermined amounts form a uniformly distributed coating of equal thickness throughout said hollow tube and along a longitudinal inside area said coating is of an increased thickness.

* * * * *